US011398702B2

(12) United States Patent
Yokotani

(10) Patent No.: US 11,398,702 B2
(45) Date of Patent: Jul. 26, 2022

(54) CONNECTOR WITH INTERLOCK CIRCUIT

(71) Applicant: Sumitomo Wiring Systems, Ltd., Mie (JP)

(72) Inventor: Koichi Yokotani, Mie (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 276 days.

(21) Appl. No.: 16/606,350

(22) PCT Filed: Apr. 9, 2018

(86) PCT No.: PCT/JP2018/014853
§ 371 (c)(1),
(2) Date: Oct. 18, 2019

(87) PCT Pub. No.: WO2018/193888
PCT Pub. Date: Oct. 25, 2018

(65) Prior Publication Data

US 2021/0336391 A1 Oct. 28, 2021

(30) Foreign Application Priority Data

Apr. 18, 2017 (JP) ..... JP2017-081894

(51) Int. Cl.
*H01R 13/64* (2006.01)
*H01R 13/631* (2006.01)
(Continued)

(52) U.S. Cl.
CPC ..... *H01R 13/6315* (2013.01); *H01R 13/5213* (2013.01); *H01R 13/701* (2013.01); *H01R 13/703* (2013.01); *H01R 13/707* (2013.01)

(58) Field of Classification Search
CPC ..... H01R 13/743; H01R 13/62938; H01R 13/62933; H01R 13/5202; H01R 13/6315;
(Continued)

(56) References Cited

U.S. PATENT DOCUMENTS 5,458,496 A * 10/1995 Itou ..... H01R 13/447 439/34
5,746,611 A * 5/1998 Brown ..... H01R 13/5213 439/135
(Continued)

FOREIGN PATENT DOCUMENTS

JP 7-326423 12/1995
JP 11-126661 5/1999
(Continued)

OTHER PUBLICATIONS

International Search Report dated Jun. 5, 2018.

*Primary Examiner* — Thanh Tam T Le
(74) *Attorney, Agent, or Firm* — Gerald E. Hespos; Michael J. Porco

(57) ABSTRACT

A connector 10 disclosed by an embodiment includes a cover (service cover 20) having a cover housing 21 and a cover connector 40, the cover connector 40 being integrally provided to the cover housing 21, and a device-side connector 50 having a receptacle 52, the cover housing 21 being fittable into the receptacle 52, a mating connector 60 configured to close an interlock circuit by being connected to the cover connector 40 being disposed inside the receptacle 52. The cover housing 21 includes preceding guide portions 27 configured to guide the cover connector 40 into a proper posture to be connectable to the mating connector 60 by sliding on an opening edge part 56 of the receptacle 52 prior to the connection of the cover connector 40 and the mating connector 60.

4 Claims, 5 Drawing Sheets

(51) Int. Cl.
*H01R 13/52* (2006.01)
*H01R 13/70* (2006.01)
*H01R 13/703* (2006.01)
*H01R 13/707* (2006.01)

(58) Field of Classification Search
CPC ..... H01R 13/5213; H01R 13/701; H01R 13/703; H01R 13/707
See application file for complete search history.

(56) References Cited

U.S. PATENT DOCUMENTS 5,820,401 A * 10/1998 Hasz ..... H01R 13/512 439/364
5,971,791 A * 10/1999 Itoh ..... H01R 13/5202 439/364
6,056,592 A 5/2000 Shigemi et al.
6,183,275 B1 * 2/2001 Okura ..... H01R 13/62933 439/157
6,685,496 B2 * 2/2004 Ookura ..... H01R 13/5202 439/372
7,393,228 B2 * 7/2008 Kabasawa ..... H01R 13/631 439/247
8,317,544 B2 * 11/2012 Matsuoka ..... H01R 13/512 439/607.55
8,610,005 B2 * 12/2013 Iida ..... H05K 5/0069 174/520
9,024,183 B2 * 5/2015 Sakakura ..... H01R 31/06 174/50.5
9,362,653 B2 * 6/2016 Tanaka ..... H01R 13/713
9,431,756 B2 * 8/2016 Kataoka ..... H01R 13/6315
9,444,186 B2 * 9/2016 An ..... H01R 24/40
9,997,974 B2 * 6/2018 Ishibashi ..... H01R 13/5219
10,116,093 B2 * 10/2018 Ishibashi ..... H02K 5/225
10,218,110 B2 * 2/2019 Wakimoto ..... H01R 13/5202
10,290,974 B2 * 5/2019 Ishibashi ..... H02K 5/225
10,310,033 B2 * 6/2019 Kundner ..... G01R 33/34007
10,355,430 B2 * 7/2019 Yokotani ..... H01R 13/5213
10,739,833 B2 * 8/2020 Chai ..... H01R 13/6315
2012/0285718 A1 11/2012 Sakakura
2013/0161176 A1 6/2013 Kikuchi et al.

FOREIGN PATENT DOCUMENTS

JP 2012-079430 4/2012
JP 2012238422 12/2012
JP 2016-018774 2/2016
JP 2017-045572 3/2017

* cited by examiner

CONNECTOR WITH INTERLOCK CIRCUIT

BACKGROUND

Field of the Invention

This specification relates to a connector.

Related Art

Japanese Unexamined Patent Publication No. 2016-18774 discloses a case-side connector provided with an interlock circuit. This case-side connector is connectable to a mating connector, and the interlock circuit is connected by connecting the case-side connector to the mating connector so that the case-side connector is switched to an energizable state. The mating connector is mounted inside a mounting recess in a terminal block. The case-side connector includes two retaining pieces and the terminal block includes two locked portions to which the of retaining pieces are lockable. Each retaining piece is resiliently deflectable and deformable and constitutes a floating mechanism of the case-side connector. If the mating connector is connected in a misaligned state to the case-side connector, each retaining piece is deflected and deformed to accommodate a misalignment.

However, the above-described case-side connector needs to be provided separately from the terminal block to enable the floating mechanism. Thus, this known case-side connector is inconsistent with goals of reducing the number of components, reducing assembly man-hours and reducing assembly facilities.

SUMMARY

A connector disclosed by this specification includes a cover having a cover housing and a cover connector that is integral with the cover housing. The connector also includes a device-side connector having a receptacle, and the cover housing can fit into the receptacle. A mating connector is configured to close an interlock circuit by being connected to the cover connector disposed inside the receptacle. The cover housing includes a preceding guide configured to guide the cover connector into a proper posture for connection to the mating connector by sliding on an opening edge part of the receptacle prior to the connection of the cover connector and the mating connector.

In assembling the cover with the device-side connector, the preceding guide slides on the opening edge part of the receptacle to guide the cover connector into the proper posture. In this way, the cover connector is connected to the mating connector while being positioned in the proper posture. Thus, a floating mechanism constituted by a different component as in the prior art can be eliminated and the number of components can be reduced. Further, an assembling operation of the different component is not necessary. Thus, assembly man-hours can be reduced and assembly facilities can be reduced as compared to the case with the floating mechanism.

The cover housing may include a cover body configured to close an opening of the receptacle and a peripheral wall projecting from the cover body along an inner peripheral surface of the receptacle while closing the opening. Additionally, the preceding guide may project toward a side opposite to the cover body from a projecting end of the peripheral wall. According to this configuration, the preceding guide can be provided by directly extending a part of the peripheral wall.

The cover housing may be laterally long, and two of the preceding guides may be provided on both end parts in a long axis direction on the projecting end of the peripheral wall. According to this configuration, the cover connector can be guided into the proper posture by the two preceding guides. Thus, the cover connector can be guided more precisely than in the case where the cover connector is guided by one preceding guide. Further, the two preceding guides are provided on the both end parts in the long axis direction of the peripheral wall. Therefore, the cover connector can be guided in a more stable posture than in the case where preceding guides are provided on both end parts in a short axis direction.

One of the preceding guides may be integral to the cover connector. According to this configuration, since the one preceding guide is integral to the cover connector, the positioning accuracy of the cover connector can be enhanced.

According to the connector disclosed by this specification, the number of components, assembly man-hours and assembly facilities can be reduced by eliminating a floating mechanism.

DETAILED DESCRIPTION

Figure 1:
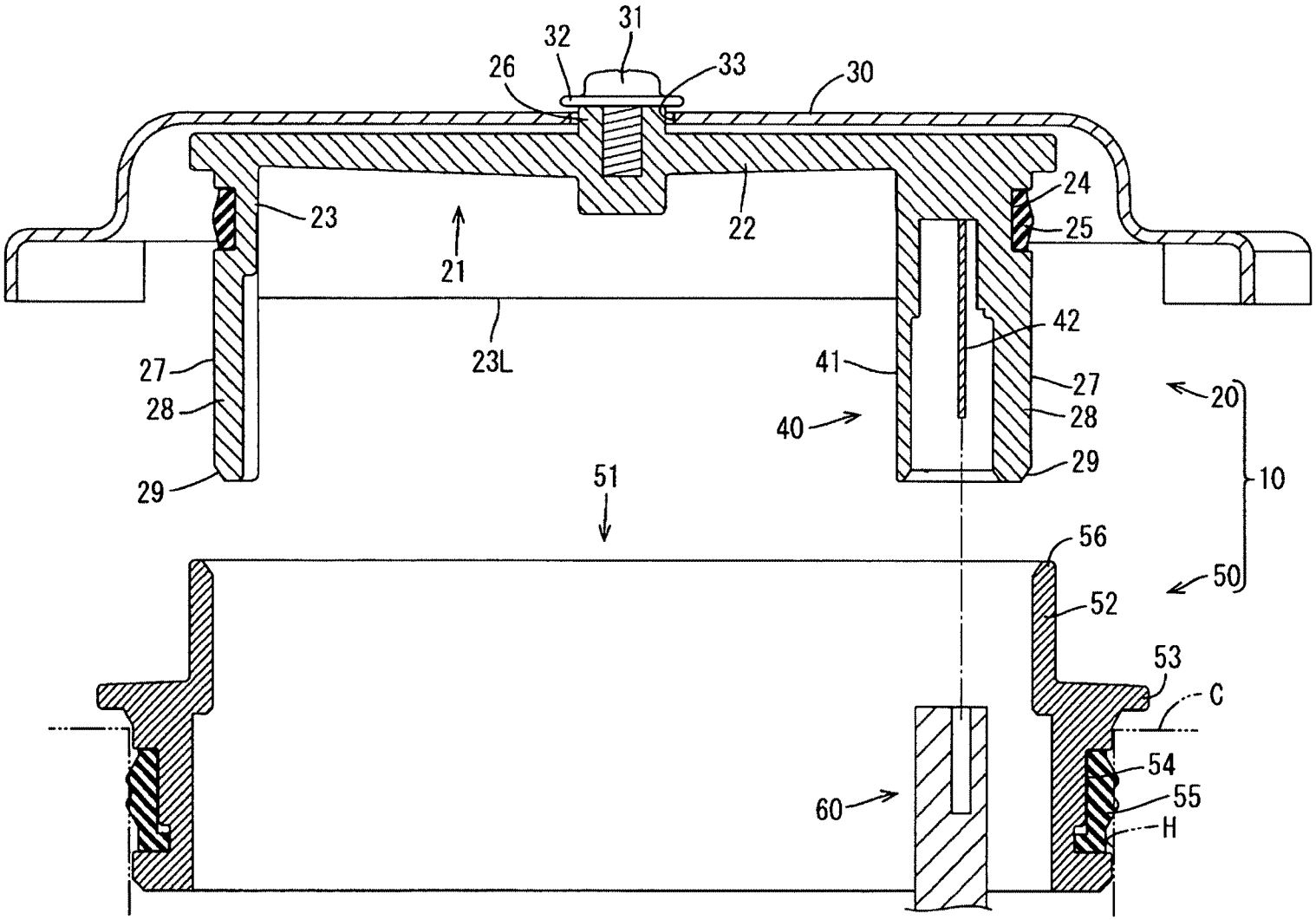
FIG. 1 is a section showing a state before a cover housing is fit into a receptacle.

An embodiment is described with reference to FIGS. 1 to 6. A connector 10 of this embodiment includes a service cover 20 and a device-side connector 50 as shown in FIG. 1. The device-side connector 50 is to be mounted on a device and specifically is mounted on a case C of the device. A mounting hole H is open in the case C of the device, and the device-side connector 50 is mounted on the case C of the device while being fit in this mounting hole H.

A mating connector 60 is provided inside the case C of the device. The mating connector 60 constitutes an interlock circuit together with a cover connector 40 to be described later. With the connectors 40, 60 connected, the interlock circuit is closed and a main circuit enters an energizable state. Further, when the connectors 40, 60 are separated, the interlock circuit is opened and the main circuit is switched to a non-energized state.

The device-side connector 50 includes a device-side housing 51 made of synthetic resin, and the device-side housing 51 is provided with a receptacle 52 open upward. A flange 53 is provided circumferentially on the outer peripheral surface of the receptacle 52 and outside the case C of the device. Further, a rubber ring accommodating portion 54 is provided circumferentially below the flange 53 in the outer peripheral surface of the receptacle 52. A rubber ring 55 is fit in the rubber ring accommodating portion 54. When the device-side housing 51 is fit into the mounting hole H of the case C of the device, the rubber ring 55 is sandwiched between the rubber ring accommodating portion 54 and the inner peripheral surface of the mounting hole H, thereby sealing the inside of the case C of the device.

Figure 5:
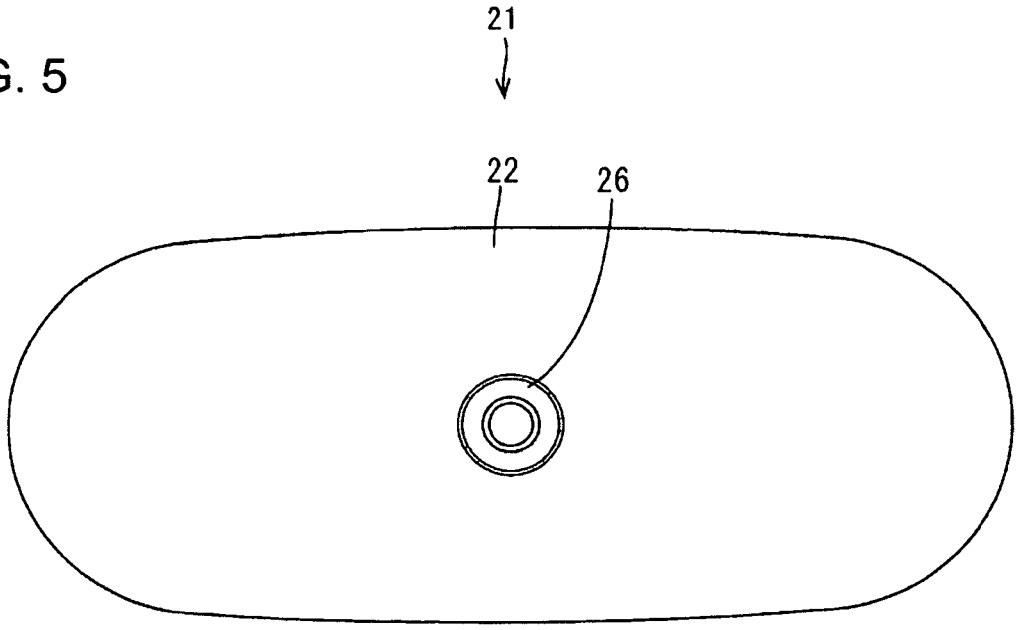
FIG. 5 is a plan view of the cover.

The service cover 20 is laterally long in a front view and includes a cover housing 21 made of synthetic resin and a shield shell 30 made of metal. As shown in FIG. 5, the cover housing 21 is laterally long.

Figure 3:
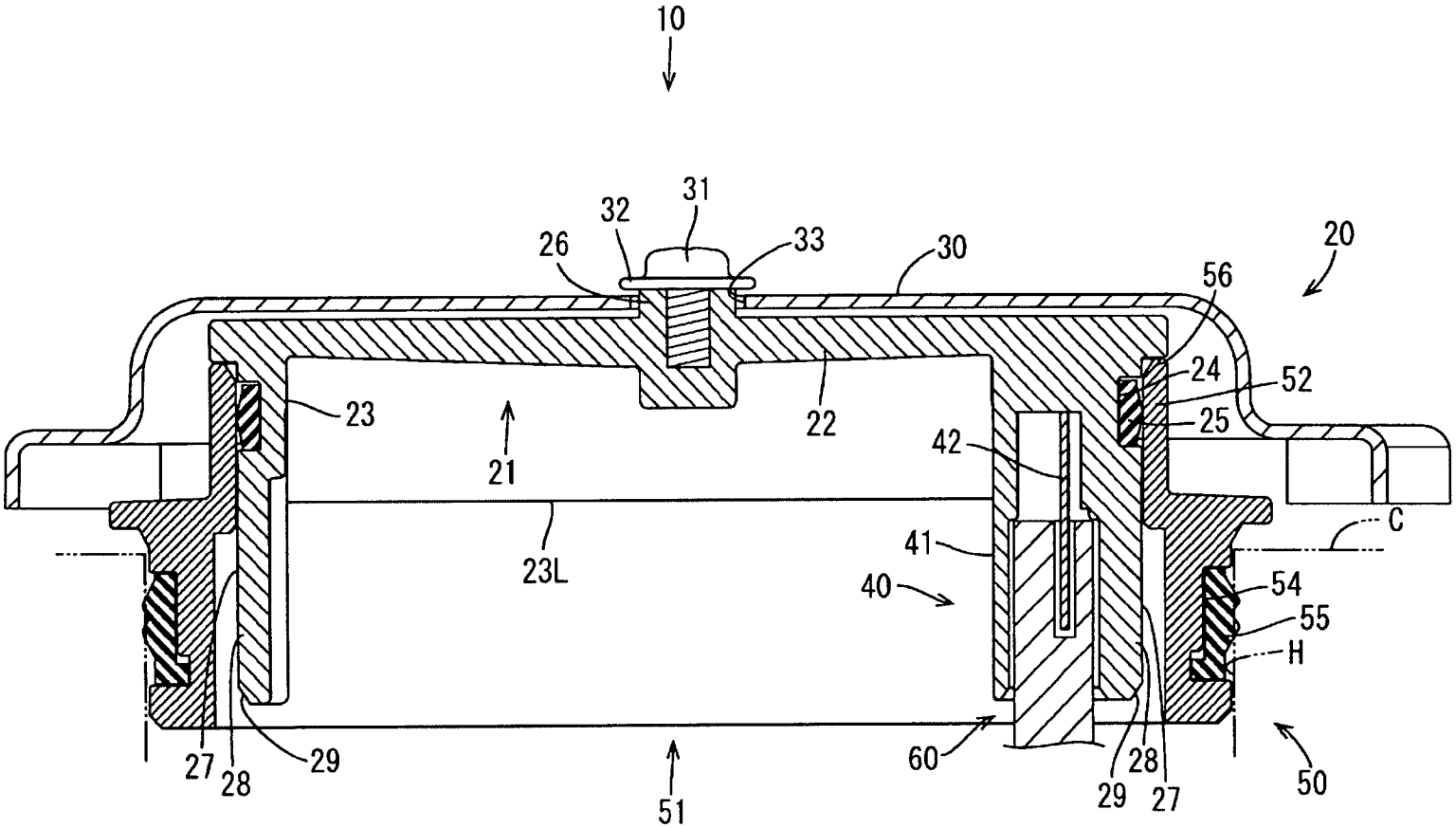
FIG. 3 is a section showing a state where the cover housing is fit in the receptacle and the cover connector is connected to a mating connector.

As shown in FIG. 3, the cover housing 21 includes a cover body 22 for closing an opening of the receptacle 52 and a peripheral wall 23 projecting down from the cover body 22 along the inner peripheral surface of the receptacle 52 while closing the opening. A cover seal accommodating portion 24 is provided circumferentially in the outer peripheral surface of the peripheral wall 23 and an annular cover seal 25 is fit inside the cover seal accommodating portion 24. When the cover housing 21 is fit into the receptacle 52, the cover seal 25 is sandwiched between the cover seal accommodating portion 24 and the receptacle 52, thereby sealing the inside of the receptacle 52.

Figure 4:
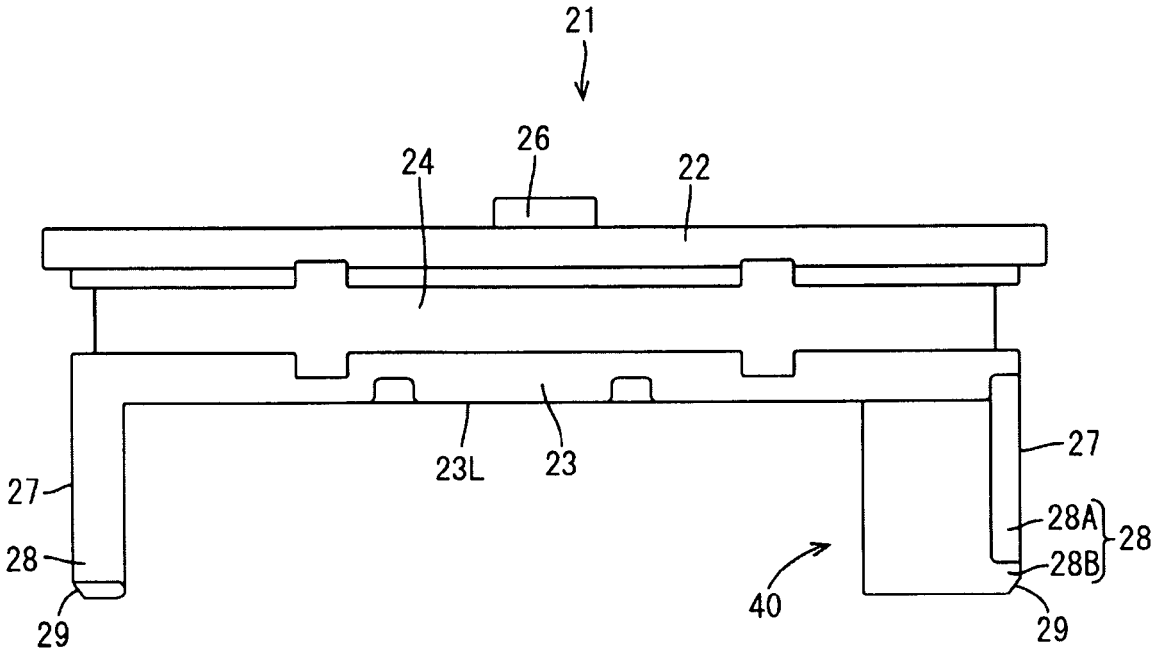
FIG. 4 is a front view of a cover.
Figure 6:
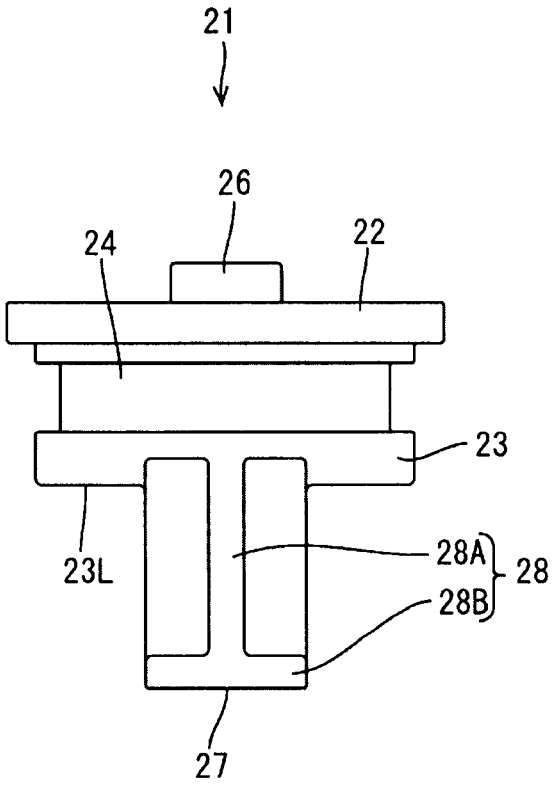
FIG. 6 is a side view of the cover.

As shown in FIGS. 4 to 6, an upwardly open boss 26 is provided in a central part of the cover body 22 and a washer-equipped bolt 31 is fastened thereto. The washer-equipped bolt 31 is a tapping screw. When the washer-equipped bolt 31 is fastened to the boss 26 from above, as shown in FIG. 3, a washer 32 of the washer-equipped bolt 31 contacts the upper end of the boss 26, thereby stopping any further fastening, and the washer-equipped bolt 31 is fixed to the boss 26.

With the washer 32 held in contact with the upper end of the boss 26, a predetermined clearance is ensured between the washer 32 and the upper surface of the cover body 22. This clearance is about two to three times as large as a plate thickness of the shield shell 30. On the other hand, the shield shell 30 is provided with an insertion hole 33 into which the boss 26 is inserted. A hole diameter of the insertion hole 33 is smaller than a diameter of the washer 32 and larger than a diameter of the boss 26. In this way, the shield shell 30 is loosely movable on the cover housing 21.

The cover connector 40 is provided on the lower surface of the cover housing 21. The cover connector 40 includes a tubular portion 41 open downward and a male terminal 42 projecting downward from a back wall (upper wall) of the tubular portion 41. The lower end of the male terminal 42 is located higher than the lower end of the tubular portion 41. As shown in FIG. 3, a part of the tubular portion 41 is integral with the peripheral wall 23.

As shown in FIG. 6, preceding guides 27 project down (toward a side opposite to the cover body 22) on a lower projecting end 23L of the peripheral wall 23. As shown in FIG. 4, two of the preceding guides 27 are provided on both end parts in a long axis direction on the lower end 23L of the peripheral wall 23. The right preceding guide 27 in FIG. 4 is integral with the cover connector 40.

As shown in FIG. 6, a guide rib 28 having an inverted T shape is provided on an outer surface of the one preceding guide 27. The guide rib 28 is composed of a vertical rib 28A extending in a vertical direction and a horizontal rib 28B extending in a lateral direction. The horizontal rib 28B is disposed on the lower end of the preceding guide 27 and is coupled to the lower end of the vertical rib 28A. The lower end of the horizontal rib 28B is provided with a tapered portion 29 for guiding. A guide rib 28 and a tapered portion 29 similar to those of the one preceding guide 27 also are provided on an outer surface of the other preceding guide 27.

Figure 2:
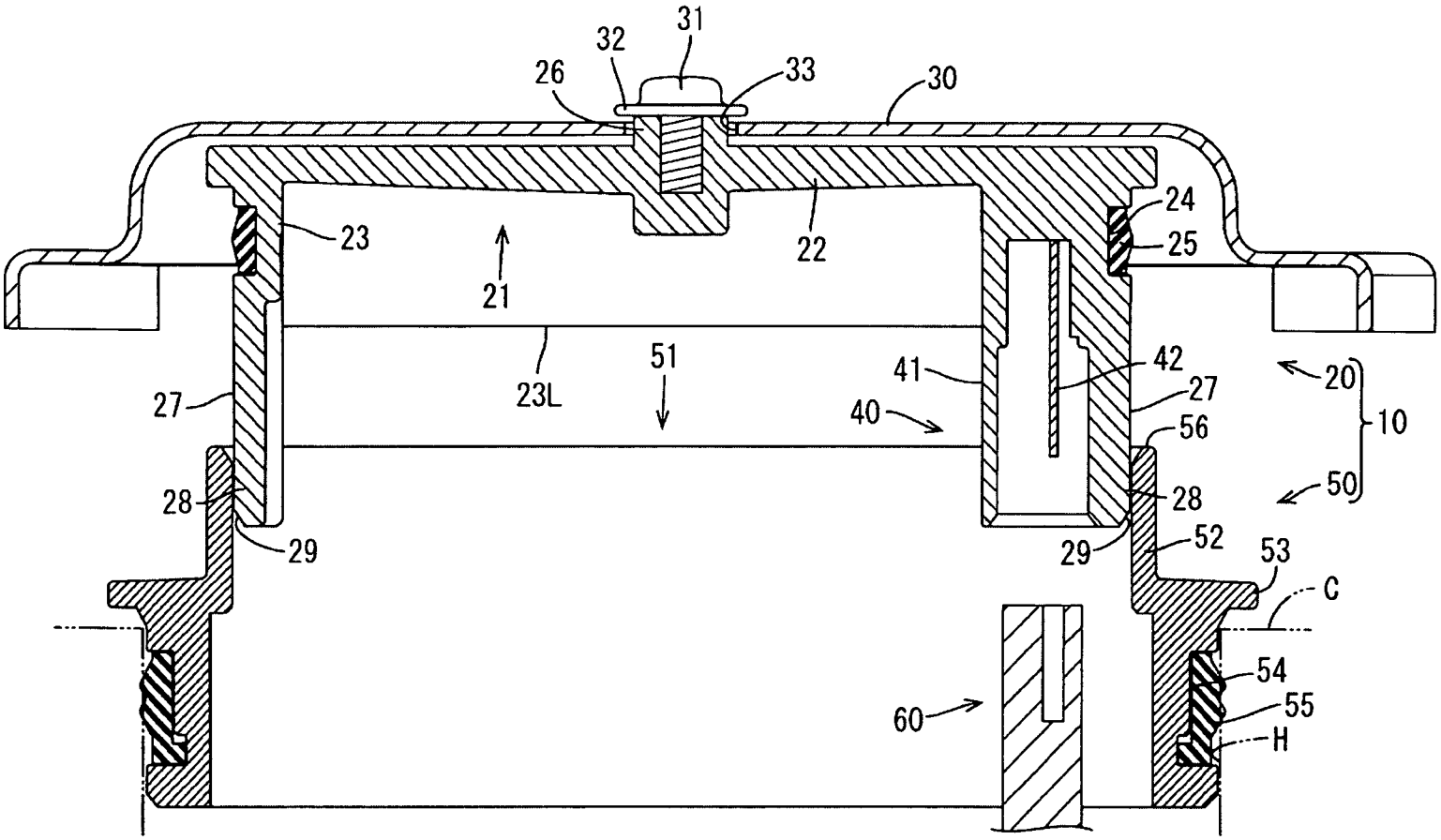
FIG. 2 is a section showing a state where a cover connector is guided into a proper posture by preceding guide portions sliding on an opening edge part of the receptacle.

When the service cover 20 is assembled with the device-side connector 50 from a state shown in FIG. 1, the tapered portions 29 of the preceding guides 27 are guided into the inside of the receptacle 52 while sliding on an opening edge 56 of the receptacle 52. Then, as shown in FIG. 2, the guide ribs 28 of the preceding guides 27 are disposed along the inner peripheral surface of the receptacle 52 and the cover connector 40 is guided into a proper posture. Thereafter, the guide ribs 28 slide on the inner peripheral surface of the receptacle 52 so that connection to the mating connector 60 progresses with the cover connector 40 kept in the proper posture.

When the cover body 22 of the cover housing 21 comes into contact with the opening edge 56 of the receptacle 52, as shown in FIG. 3, the fitting of the cover housing 21 and the receptacle 52 is completed and the connection of the cover connector 40 and the mating connector 60 is completed. When the connection of the cover connector 40 and the mating connector 60 is completed, the interlock circuit is closed and the main circuit enters an energizable state. As just described, in this embodiment, the cover connector 40 is positioned in the proper posture by the preceding guides 27 before the connection of the cover connector 40 and the mating connector 60 is started. Thus, the cover connector 40 and the mating connector 60 can be connected reliably even if a floating mechanism is eliminated.

As described above, the connector 10 disclosed by this embodiment includes the service cover 20 having the cover housing 21 and the cover connector 40, with the cover connector 40 being integral to the cover housing 21, and the device-side connector 50 having the receptacle 52. The cover housing 21 is fittable into the receptacle 52. The mating connector 60 is configured to close the interlock circuit by being connected to the cover connector 40 that is disposed inside the receptacle 52, and the cover housing 21 includes the preceding guides 27 configured to guide the cover connector 40 into the proper posture to be connectable to the mating connector 60 by sliding on the opening edge 56 of the receptacle 52 prior to the connection of the cover connector 40 and the mating connector 60.

In assembling the cover with the device-side connector 50, the preceding guides 27 slide on the opening edge 56 of the receptacle 52 to guide the cover connector 40 into the proper posture. In this way, the cover connector 40 is connected to the mating connector 60 while being positioned in the proper posture. Thus, the floating mechanism constituted by a different component as before can be eliminated and the number of components can be reduced. Further, since an assembling operation of the different component is not necessary, assembly man-hours can be reduced and assembly facilities can be reduced as compared to the case with the floating mechanism.

The cover housing 21 may include the cover body 22 configured to close the opening of the receptacle 52 and the peripheral wall 23 projecting from the cover body 22 along the inner peripheral surface of the receptacle 52 while closing the opening. The preceding guides 27 may project toward a side opposite to the cover body 22 from the projecting end (lower end 23L) of the peripheral wall 23. According to this configuration, the preceding guides 27 can be provided by directly extending parts of the peripheral wall 23.

The cover housing 21 may be laterally long, and the preceding guide portions 27 may be provided on the both end parts in the long axis direction on the projecting end of the peripheral wall 23. According to this configuration, the cover connector 40 can be guided into the proper posture by the two preceding guides 27. Thus, the cover connector 40 can be guided more precisely than in the case where the cover connector 40 is guided by one preceding guide 27. Further, since the preceding guides 27 are provided on the both ends in the long axis direction of the peripheral wall 23, the cover connector 40 can be guided in a more stable posture than in the case where two preceding guides are provided on both ends in a short axis direction.

One of the preceding guides 27 may be integral to the cover connector 40 According to this configuration, since the one preceding guide 27 is integral with the cover connector 40, the positioning accuracy of the cover connector 40 can be enhanced.

The invention is not limited to the above described and illustrated embodiment. For example, the following various modes also are included.

Although the guide rib 28 is provided on the preceding guide 27 in the above embodiments, the preceding guide may not be provided with the guide rib.

Although the preceding guide 27 is provided on the lower end 23L of the peripheral wall 23 in the above embodiment, a preceding guide may be provided on the lower surface of the cover body 22

Although the two preceding guides 27 are provided in the above embodiment, only one, three or more preceding guides 27 may be provided.

Although the one preceding guide 27 is integral with the cover connector 40 in the above embodiment, the one preceding guide 27 may be provided separately from the cover connector 40.

LIST OF REFERENCE SIGNS

10 . . . connector
20 . . . service cover (cover)
21 . . . cover housing
22 . . . cover body
23 . . . peripheral wall
23L . . . lower end (projecting end)
27 . . . preceding guide
28 . . . guide rib
40 . . . cover connector
50 . . . device-side connector
52 . . . receptacle
56 . . . opening edge
60 . . . mating connector

The invention claimed is:

1. A connector, comprising:

a cover including a cover housing and a cover connector, the cover connector being integral with the cover housing; and a device-side connector including a receptacle, the cover housing being fittable into the receptacle, a mating connector configured to close an interlock circuit by being connected to the cover connector disposed inside the receptacle;

the cover housing including a preceding guide projecting towards the mating connector in a connecting direction and having a guide rib on an outer surface thereof, the guide rib comprising a vertical rib extending in the connecting direction and a horizontal rib on an end of the vertical rib extending normal to the connecting direction configured to guide the cover connector into a proper posture to be connectable to the mating connector by the horizontal rib sliding on an opening edge of the receptacle prior to connection of the cover connector and the mating connector.

2. The connector of claim 1, wherein:

the cover housing includes a cover body configured to close an opening of the receptacle and a peripheral wall projecting from the cover body along an inner peripheral surface of the receptacle while closing the opening; and the preceding guide projects toward a side opposite to the cover body from a projecting end of the peripheral wall.

3. The connector of claim 2, wherein the cover housing is laterally long, and two of the preceding guides are provided on both end parts in a long axis direction on the projecting end of the peripheral wall.

4. The connector of claim 3, wherein one of the preceding guides is integral with the cover connector.

* * * * *